United States Patent [19]

Hall

[11] 4,389,047

[45] Jun. 21, 1983

[54] ROTARY EXERCISE DEVICE

[76] Inventor: Lawrence W. Hall, 2411 Prospect, #307, Hermosa Beach, Calif. 90254

[21] Appl. No.: 222,279

[22] Filed: Jan. 2, 1981

[51] Int. Cl.[3] ..... A63B 19/04

[52] U.S. Cl. ..... 272/69; 320/61

[58] Field of Search ..... 272/69, 115, 1 R, 1 E, 272/73; 320/61, 62; 415/124; 280/206, 207, 208; 51/164.1; 308/31, 32, 33; 119/29; 290/50

[56] References Cited

U.S. PATENT DOCUMENTS

| | | | |
|---|---|---|---|
| 321,278 | 6/1885 | Harsin et al. . | |
| 362,291 | 5/1887 | MacKay | 308/31 |
| 554,138 | 2/1896 | Negbaur et al. | 290/50 X |
| 641,424 | 1/1900 | Ziebell . | |
| 685,685 | 10/1901 | Krahenbuhl . | |
| 883,485 | 3/1908 | Ridgway | 272/1 R |
| 1,399,853 | 12/1921 | Ferguson . | |
| 1,796,437 | 3/1931 | Burger . | |
| 3,210,634 | 10/1965 | Stern | 320/61 |
| 3,240,947 | 3/1966 | Mas | 320/61 X |
| 3,352,426 | 11/1967 | Carlson | 272/73 X |
| 3,443,664 | 5/1969 | Frassanito et al. | 185/15 |
| 3,536,324 | 10/1970 | Ahrens | 272/1 R |
| 3,711,090 | 1/1973 | Fiedler | 272/69 |
| 3,869,121 | 3/1975 | Flavell | 272/79 |
| 3,903,613 | 9/1975 | Bisberg | 272/73 X |
| 4,060,239 | 11/1977 | Pfleiderer et al. | 272/73 |
| 4,084,810 | 4/1978 | Forsman | 272/73 |
| 4,204,673 | 5/1980 | Speer, Sr. | 272/69 |

FOREIGN PATENT DOCUMENTS

| | | | |
|---|---|---|---|
| 2267702 | 11/1975 | France | 119/29 |
| 380005 | 4/1940 | Italy . | |
| 26372 | of 1913 | United Kingdom | 272/1 R |
| 277765 | 9/1927 | United Kingdom | 272/1 R |

OTHER PUBLICATIONS

Moon Mullins by Ferd & Tom Johnson, Washington Post, Nov. 16, 1979, p. F 10.

Bulls on Treadmills, *Washington Star,* Nov. 24, 1933, p. B-1.

*Primary Examiner*—Richard C. Pinkham

*Assistant Examiner*—Arnold W. Kramer

*Attorney, Agent, or Firm*—Knobbe, Martens, Olson & Bear

[57] ABSTRACT

A rotary-type exercise device is driven by the running motion of the user who jogs or runs within a cylindrical mill wheel. The rotation of the mill wheel is transferred to a driveshaft, which, in turn, drives a generator. The power thus generated is stored in a battery for later use. The type of exercise involved in using this rotary device is singularly useful in promoting overall cardiovascular and pulmonary fitness. In addition, energy generated by the device supplements and reduces the overall amount of energy used and obtained from fossil fuels. There is a one-way drive mechanism connecting the mill wheel to the driveshaft.

8 Claims, 7 Drawing Figures

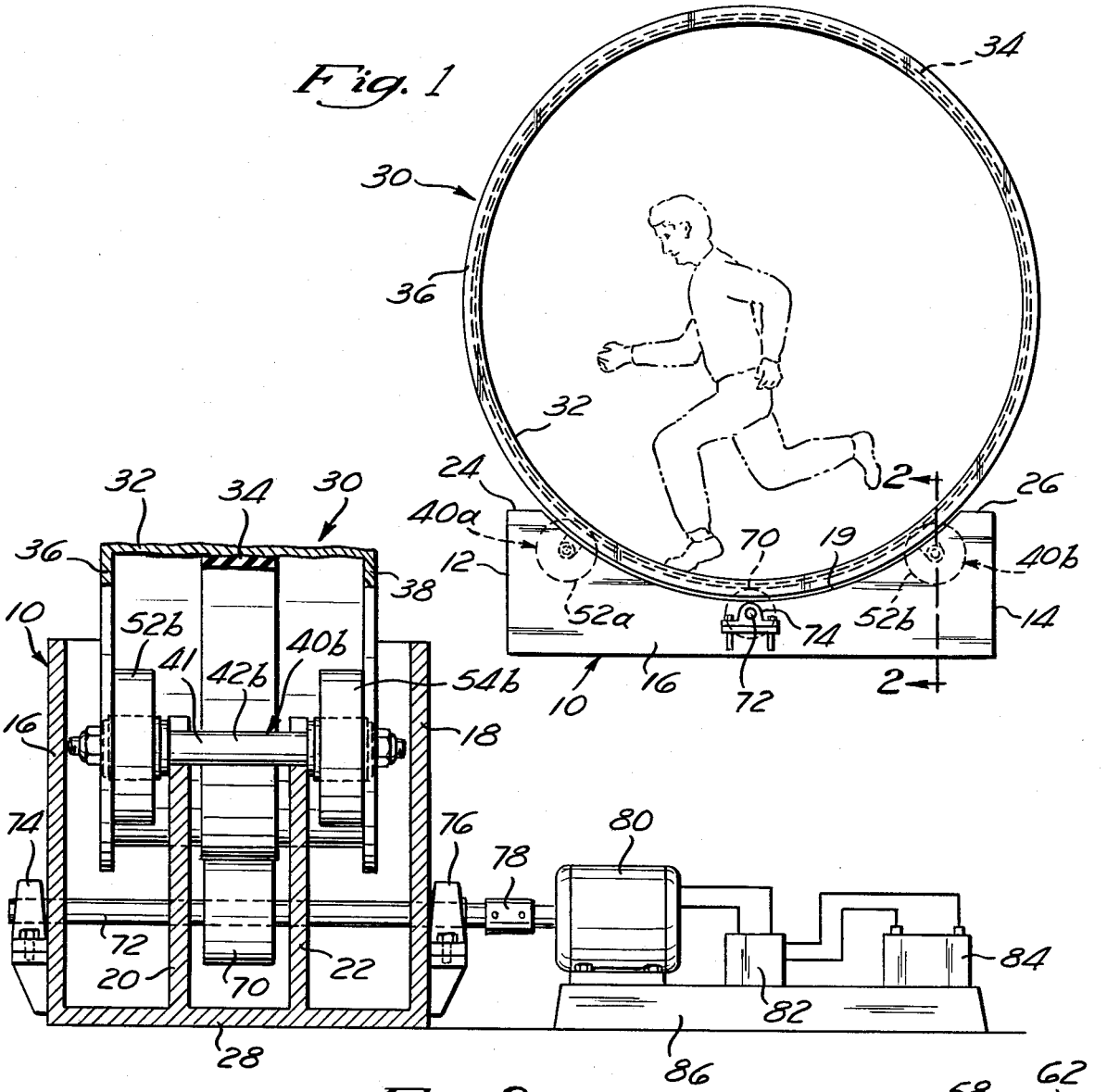
Fig. 1
Fig. 2
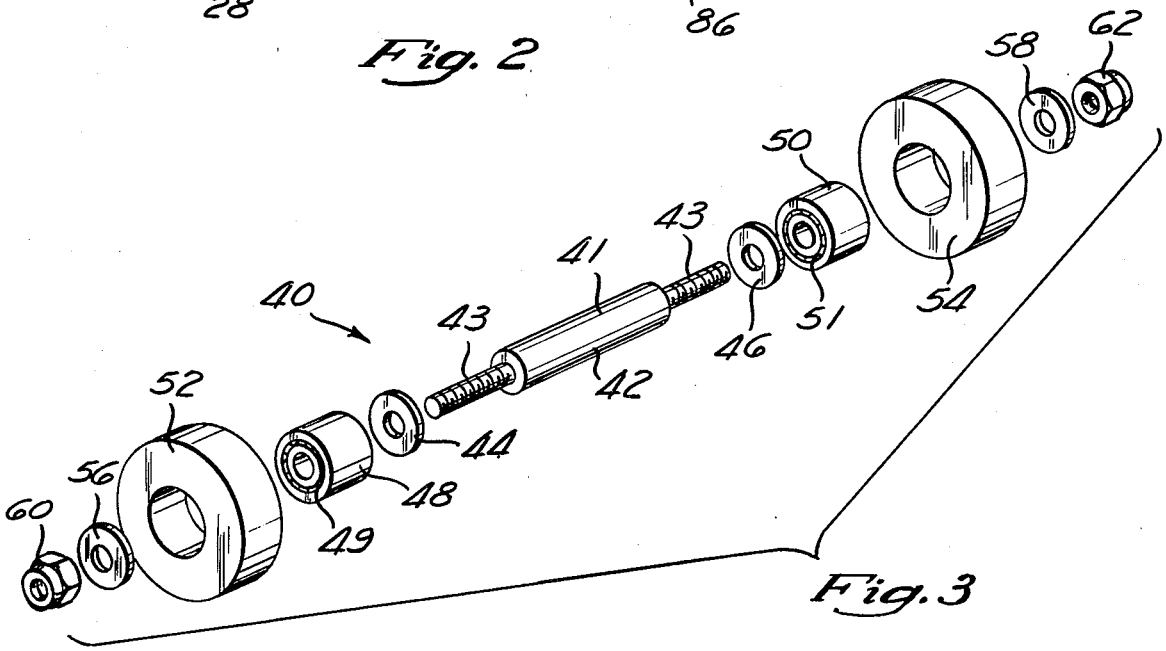
Fig. 3

Fig. 4
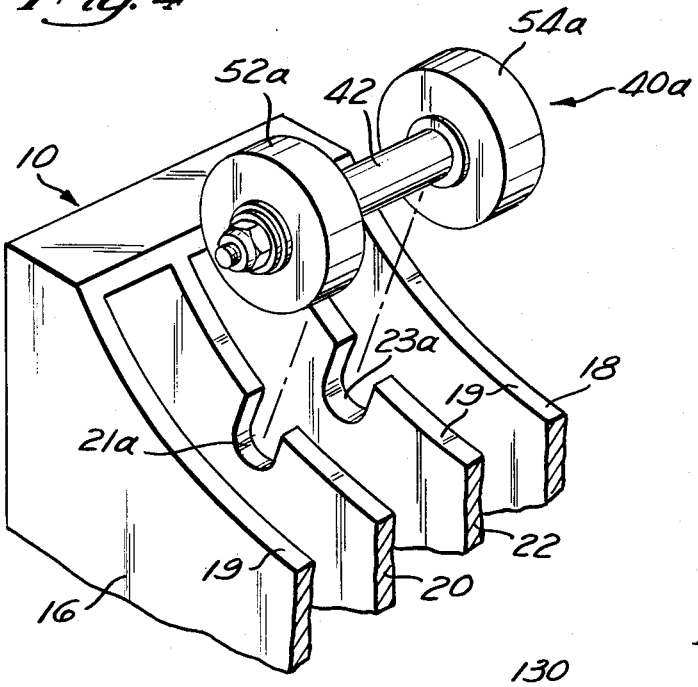
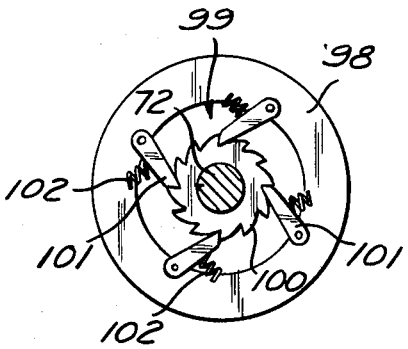
Fig. 6
Fig. 5
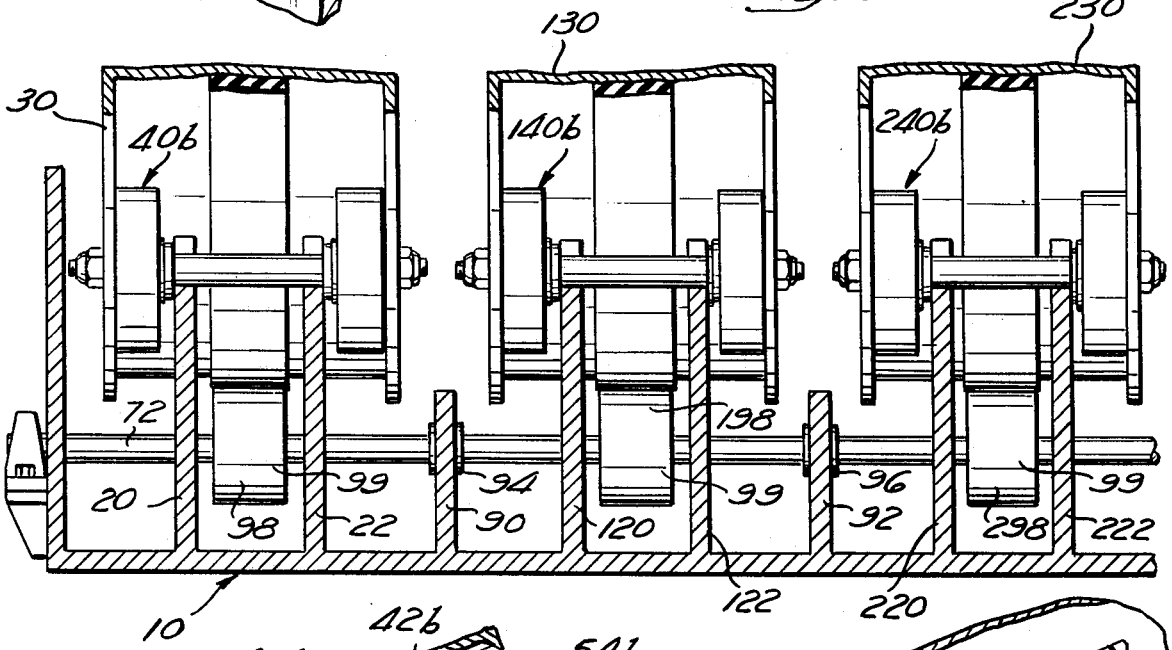
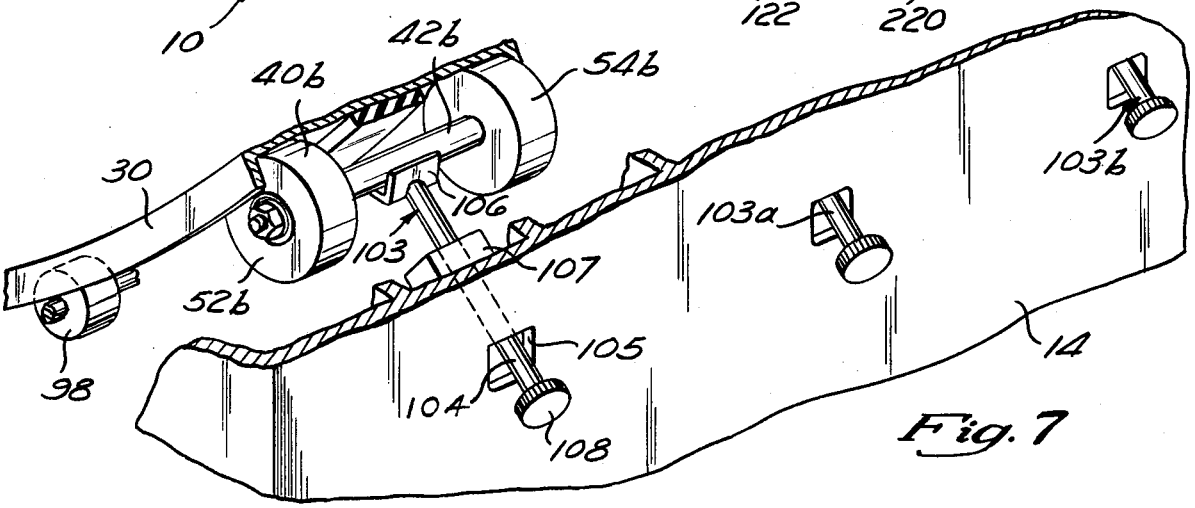
Fig. 7

ROTARY EXERCISE DEVICE

BACKGROUND OF THE INVENTION

Considerable time and money is spent on getting in shape and staying fit, and the numbers of joggers on the streets is ever increasing. There are also a number of mechanical exercise devices on the market, which fall into several classes. For example, there are the bicycle-type devices, which use electrical or mechanical means of resistance to vary the effort required to pedal, weight-lifting devices to exercise various muscles throughout the body, and running type exercise devices, a class in which the present invention is included. Such running-type devices are quite popular since they permit one to keep in shape while promoting overall cardiovascular and pulmonary fitness. Other types of exercise devices, on the other hand, primarily exercise only one particular set of muscles.

Running-type exercise devices have as a common function the provision for allowing a person to jog or run while essentially remaining stationary. Most present devices use a treadmill design, consisting of a flexible belt stretched over rollers. The runner mounts the machine and is restrained from moving while jogging or running either by grasping rails provided at the sides of the machine or by means of a belt which is fastened to the device. This restraint is a major disadvantage, since the runner is not able to move freely and naturally as is done when running in the conventional manner on a road or track.

Another topic of major concern is energy conservation, particularly the conservation of fossil fuel resources. Alternate energy sources being commonly explored include solar, wind, and wave power, with solar and wind power generating means being used by many households as a supplemental source of energy. Although mechanical power generated by animals has been utilized, no device to date has harnessed the energy generated by a person using a running-type exercising device.

SUMMARY

The present invention relates generally to a running-type exercise device adapted to generate electrical energy which may be stored for future use. It provides a convenient and natural way of obtaining the physical benefits of running or jogging in the privacy of one's own home or yard, and the satisfaction of knowing that one's efforts are generating useful power and thus reducing dependence on outside energy sources. Thus, it is a unique feature of the present invention that it reaches two commonly shared concerns: physical fitness and energy conservation.

The use of a rotary type mill wheel of a diameter of approximately nine feet allows a normal-sized adult to run on the inside surface with relative ease and comfort. Since the surface being run upon is round, the force of gravity will act to keep the runner at the bottom of the mill wheel when he is running. This eliminates the need for rails or restraining belts, and makes the rotary device a more comfortable way of running or jogging on an exercise machine.

In the preferred embodiment, the wheel itself is supported by a base and several smaller support wheels. There are four support wheels for each mill wheel, and the support wheels are mounted in pairs on an axle. The axles are mounted in the base so that the support wheels support the mill wheel, and the mill wheel is able to rotate freely. The base is of a shape so as not to interfere with the motion of the mill.

Mounted underneath the mill wheel is a contact wheel, which is in frictional contact with the outside surface of the mill wheel. The contact wheel is mounted on a driveshaft, which is, in turn, connected to the armature shaft of a generator. Thus, when a runner runs or jogs in the mill wheel, the generator is driven, producing an electric current which is stored in a storage battery for later use.

By the use of the present invention, effort expended in exercising, which was formerly wasted, is now harnessed and converted into a useful form. This device is unique in that it not only promotes cardiovascular and pulmonary fitness in the user, but also generates useful electrical energy which may be used as a supplement to conventional power. A further advantage of the present device is that it allows the user to exercise in any weather or season, at any time of day or night, in the privacy of the user's own home. The device would also provide a supply of emergency power for lighting in the event of a blackout, or, in cooler climates, to provide power for electric blankets in the event of a severe fuel shortage.

BRIEF DESCRIPTION OF THE DRAWINGS

FIG. 1 is a side view of the rotary exercise device and generator showing the general configuration of the mill wheel base, support wheels and contact wheel;

FIG. 2 is a partial sectional view taken along line 2—2 of FIG. 1 showing the side of the rotary device and its mechanical drivetrain;

FIG. 3 is an exploded perspective view of the support wheel mounting assembly;

FIG. 4 is a broken-away perspective view showing the method of mounting the support wheel assembly in the base;

FIG. 5 is a sectional view similar to FIG. 2, but showing an alternate embodiment of the invention having multiple mill wheels;

FIG. 6 is a side sectional view illustrating a ratchet mechanism utilized in the embodiment of FIG. 5; and FIG. 7 is a partially broken away perspective view showing a jacking device for disengaging each mill wheel from its respective contact wheel.

DETAILED DESCRIPTION OF THE INVENTION

FIG. 1 shows the general configuration of the present rotary exercise device and the relative locations of the mill wheel 30, the support wheels **52*a* and 52*b*, with matching support wheels 54*a* and 54*b* (not shown in FIG. 1) directly behind support wheels 52*a* and 52*b*, and the base 10. As shown in FIGS. 1 and 2, the mill wheel 30 is a cylindrical segment in which the runner runs or jogs. The size of the mill wheel 30** must be large enough to allow a normal-sized adult to comfortably run or jog within the cylinder while using a normal-length stride. Dimensions sufficient for these purposes have been found to be about nine feet for the diameter and two feet for the length of the segment, although other suitable dimensions can also be employed.

The present invention is easy-to-use as well as being dependable and long lasting. The mill wheel 30 is made of a strong, durable, light weight material, preferably aluminum. The use of a light weight material for the mill wheel 30 will reduce the amount of the mill wheel's inertia, making it easier to start the rotation of the mill wheel 30 and to slow it down or stop it quickly. Thus, the mill wheel 30 will not act as a fly wheel.

The use of the rotary device is also facilitated by an inner surface 32 on the mill wheel 30 which is made of a non-skid material, such as rubber, and provides the runner with good footing to prevent him from slipping while using the mill.

An important advantage of the rotary design is that it eliminates the need for restraints or hand-rails to maintain the runner's balance and keep him or her on the device. Since the runner is running within the mill wheel 30, the force of gravity acts to keep him at its lowermost part. Therefore, the design of the wheel 30 keeps the runner essentially stationary while running or jogging. Running on the mill is thus more comfortable and natural than running on prior art devices.

The outer surface of the mill wheel 30 has a belting strip 34 around it, as can be seen in FIG. 2. The belting strip 34 runs around the middle of the outer surface of the mill wheel 30, and is not as wide as the mill wheel 30. It is made of a material with a high coefficient of friction, such as rubber, and is attached to the mill wheel 30 so that it is non-movable with respect to the mill wheel 30, preferably by a strong adhesive.

The mill wheel 30 is supported and maintained in position by two support wheel assemblies 40*a* and 40*b*, as seen in FIGS. 1 and 2. The support wheel assemblies 40*a* and 40*b* are identical, and are shown in an exploded view in FIG. 3. The support wheels 52 and 54 are mounted on wheel rims 48 and 50 having bearings 49 and 51, respectively. These bearings 49 and 51 assure virtually friction-free rotation of the support wheels 52 and 54,. The wheel rims 48 and 50 are mounted on opposite ends of the support axle 42 which has a large non-threaded diameter 41 in the middle and a smaller threaded diameter 43 at the ends. The wheel rim 48 is mounted onto the axle 42 between the washers 44 and 56, and the wheel rim 50 is mounted onto the axle 42 between the washers 46 and 58. The support wheels 52 and 54 are then secured to the axle 42 by hubs 60 and 62, which screw onto the threaded end portions 43 of axle 42.

The length of the axle 42 is determined by the width of the mill wheel 30. The mill wheel 30 has outwardly protruding retaining lips 36 and 38, shown best in FIG. 2. The axle 42 is long enough to make support wheels 52 and 54 ride just inside of retaining lips 36 and 38, respectively, which form a track on the mill wheel 30. Thus, as shown in FIG. 2, the support wheels 52 and 54 not only support the mill wheel 30, but in cooperation with retaining lips 36 and 38 prevent it from moving laterally off of the support wheels 52 and 54.

The base 10 of the invention is designed so as not to obstruct the movement of the mill wheel 30, allowing it to rotate freely on the support wheels 52*a*, 52*b*, 54*a*, andd 54*b*. The design of the base 10, shown in FIGS. 1 and 2, is only one of many possible configurations. Any design for base 10 will serve equally well as long as it provides the necessary support for the support wheel assemblies 40 and the driveshaft 72, which is described below.

The base 10 of the embodiment shown in FIGS. 1 and 2 has four parallel structural members, which are also shown in the cutaway view of FIG. 4 and are described in sequence. These structural members include the end plate 16, the support ribs 20 and 22, and the generator end plate 18. All four members are of the same general rectangular shape and have a concave arc 19 cut out of the top to receive the mill wheel 30. The width of the base 10 between the end plate 16 and the generator end plate 18 is sufficient to receive the support wheel assembly 40 as shown in FIG. 2, so that the entire assembly fits lengthwise between the end plates 16 and 18. Support ribs 20 and 22 are spaced apart so that the distance between them is equivalent to the length of the larger diameter portion 41 of support axle 42, best shown in FIG. 3. Support ribs 20 and 22 have notches 21*a* and 23*a*, respectively, into which support axle 42 of support wheel assembly 40*a* fits, as shown in FIG. 4. The other support wheel assembly 40*b* is mounted in notches in the support ribs 20 and 22 in a similar manner, as shown in FIG. 1. These notches are of a length so that when support wheel assemblies 40*a* and 40*b* are inserted into them, support wheels 52*a*, 54*a*, 53*b*, and 54*b* protrude above the arc 19 so that the mill wheel 30 rests upon them and is able to turn freely, not contacting any part of the base 10. As mentioned earlier, and shown in FIG. 2, retaining lips 36 and 38 on mill wheel 30 cooperate with support wheels 52*a*, 54*a*, 52*b*, and 54*b* to keep the mill wheel 30 from moving laterally.

The base is completed by bottom plate 28, shown in FIG. 2, and the side plates 12 and 14 and the top plates 24 and 26 (FIG. 1). The bottom plate 28, side plates 12 and 14, and the top plates 24 and 26 all hold the end plate 16, support ribs 20 and 22, and generator end plate 18 rigid with respect to one another.

The drivetrain is shown in FIG. 2. The contact wheel 70 has an outer surface with a high coefficient of friction, and is fixedly attached to driveshaft 72 so that the contact wheel 70 rotates with the driveshaft 72. The driveshaft 72 is mounted in the base 10 by means of bearings 74 and 76 mounted in end plate 16 and generator end plate 18, respectively, so that the contact wheel 70 is in frictional contact with the belting strip 34 on the mill wheel 30. The end of driveshaft 72 protruding through bearing 76 is fastened to the armature shaft of the generator 80 by any suitable connecting means, in the preferred embodiment, a keyed collar 78.

The generator 80 is preferably a small DC generator mounted on the generator base 86, and is connected through a voltage regulator 82 to a storage battery 84. The generator and the rest of this electrical system are standard components.

The rotary exercise device is designed to generate electricity when a user walks, jogs, or runs in the mill wheel 30. The mill wheel 30 is turned by the user, and in turn rotates driveshaft 72 by means of frictional contact between the belting strip 34 and the contact wheel 70. The driveshaft 72 turns the armature of the generator 80, which generates electricity for storage in the battery 84. The energy thus stored may be later used to power lights, portable televisions, or small appliances which use DC.

The present invention is also an excellent means of exercise, since running and jogging are known to be conducive of overall cardiovascular and pulmonary fitness. It allows the user to exercise in any weather or season, at any time of the day or night, and in the privacy of the user's own home.

Another embodiment of the present invention is shown in FIG. 5, the primary difference being that there is more than one mill wheel. The embodiment of FIG. 5 features 3 wheels 30, 130, and 230, mounted in the same base 10. The base 10 has three pairs of support ribs, 20 and 22, 120 and 122, and 220 and 222, which support support wheel assemblies 40*a* and 40*b*, 140*a* and 140*b*, and 240*a* and 240*b*, respectively. The drive wheel assemblies 40 support the mill wheels 30, 130 and 230 in the same manner as in the primary embodiment. The driveshaft 72 has two additional driveshaft supports 90 and 92, with bearings 94 and 96, respectively.

The contact wheels 98, 198, and 298 of this embodiment are each provided with the conventional ratchet mechanism 99, shown in detail in the side cross sectional view of FIG. 6, so that if only one of the mill wheels is in use, the user does not have to turn the other two mill wheels. Thus, mechanical energy generated by the user is not wasted in turning the other mills but can be directly utilized in producing electrical current. Each contact wheel (for example, wheel 98, shown in FIG. 6) rotates about a ratchet 100 mounted on the driveshaft 72 when a runner is running in mill wheel 30. If the contact wheel 98 is rotating approximately as fast or faster than the driveshaft 72, the pawls 101 will engage the teeth of the ratchet 100, allowing that wheel to drive the driveshaft 72 and the generator 80. When the contact wheel 98 slows down or stops, e.g. when the runner desires to dismount the mill wheel 30, the ratchet 100 will allow slippage, being aided by the spring loading 102 of the pawl 101. Thus, runners in the other mill wheels 130 and 230 need not stop to allow the runner in mill wheel 30 to dismount but can continue exercising and generating power uninterrupted.

FIG.7 illustrates a jacking mechanism 103 that can be utilized to raise or lower the mill wheel 30 with respect to the contact wheel 98, to either disengage them or to provide for a firmer engagement. The jack member 104 extends at an angle through an opening 105 in the side plate 14 of the present rotary exercise device. A V-shaped plate 106 is attached to the distal end of the jack member 104 and engages the axle 42*b* of the wheel assembly 40*b*. The jack member 104 is threaded and is threadedly engaged with a threaded block 107 mounted securely on the interior surface of the side plate 14, thereby serving to support the jack member 104 in its angled position. Thus, rotation of the knob 108 on the proximal end of the jack member 104 in one direction will advance the jack member 104, thus causing the support wheels 52*b* and 54*b* to lift the mill wheel 30 slightly and cause disengagement with the contact wheel 98. Rotation of the knob 108 in the opposite direction will cause the jack member 104 to retreat, thus permitting the mill wheel 30 to more firmly engage the contact wheel 98 due to the weight of the mill wheel.

Therefore, the jacking mechanism 103 as shown in FIG. 7 and described above can be utilized in the embodiment of FIG. 5 in lieu of the ratchet mechanism 99, as shown in FIG. 6. That is, if a runner in mill wheel 30 desires to run without also turning mill wheels 130 and 230, he can simply utilize jacking mechanisms 103*a* and 103*b* to lift mill wheels 130 and 230 from their respective contact wheels 198 and 298. In addition, these jacking mechanisms can be utilized in conjunction with the ratchet mechanism 99 in the event that the belting strip 34 on the exterior of the mill wheel 30 becomes worn and frictional contact with the contact wheel 98 either decreases or is lost totally. Thus, the jacking mechanism 103 could be used to lower the support wheels 52*b* and 54*b*, thus lowering mill wheel 30 and providing once again a firm frictional engagement between the contact wheel 98 and the belting strip 34. The jacking mechanism can also be utilized for this purpose in conjunction with the single mill wheel embodiment shown in FIGS. 1 through 4.

What is claimed is:

1. A rotary exercising device for power generation, comprising:

a cylindrical light weight mill wheel of a size sufficient to allow a normal-sized adult to run within said mill wheel to rotate said mill wheel;

support wheels for said mill wheel having axes parallel to the axis of said mill wheel, said support wheels being rotatably mounted so that said mill wheel rotates freely upon said support wheels;

a base for mounting said support wheels and said mill wheel without interfering with the rotation of said mill wheel and said support wheels;

a driveshaft rotatably mounted to said base;

a contact wheel in frictional contact with said mill wheel so that rotation of said mill wheel produces rotation of said contact wheel;

ratchet means connected between said contact wheel and said driveshaft for permitting said contact wheel to drive said driveshaft and for permitting deceleration of said mill wheel and said contact wheel relative to said driveshaft;

a generator connected to said driveshaft so that the armature of said generator turns when said driveshaft turns to generate power when said mill wheel is turned by a user running or jogging within said mill wheel; and storage means for storing the power generated by said generator.

2. The rotary exercising device for power generation of claim 1 wherein said mill wheel is provided with retention means to limit lateral movement of said mill wheel on said support wheels.

3. The rotary exercising device for power generation of claim 1 wherein a belting strip having a high coefficient of friction is mounted on the outside surface of said mill wheel, and said contact wheel is mounted on said driveshaft, said contact wheel having a surface with a high coefficient of friction in frictional contact with said belting strip on said mill wheel so that when said mill turns said driveshaft is caused to turn.

4. An exercise device for power generation, comprising:

a base having an upper arcuate portion;

a plurality of support wheels rotatively mounted on said base so that a portion of each of said wheels extends above said arcuate portion;

a mill wheel rotatable on and supported by said plurality of wheels, said mill wheel having substantially the same radius as said arcuate portion of said base and having a diameter sufficient to permit a user to run in a normal manner on the interior surface of said mill wheel withhout the need for hand rails, restraints, supports, and the like;

a contact wheel in frictional engagement with the exterior surface of said mill wheel such that the rotation of said mill wheel due to the running or jogging of said user produces rotation of said contact wheel;

generator means for producing useful electrical current in response to the rotation of an armature; and means including a one way drive for connecting said contact wheel and said armature of said generator such that rotation of said mill wheel causes rotation of said armature to generate a useful electrical current.

5. An exercise device as defined in claim 4 wherein said connecting means comprises a drive shaft on which said contact wheel is mounted.

6. An exercise device as defined in claim 5 having a plurality of contact wheels connected to said shaft and a plurality of mill wheels, each said mill wheel in frictional engagement with a corresponding one of said contact wheels, each said contact wheel including one of said one way drive means.

7. An exercise device as defined in claim 6 wherein said one way drive means comprising ratchet means connects each said contact wheel and said drive shaft such that rotation of one of said mill wheels does not produce rotation in all such mill wheels.

8. An exercise device as defined in claim 7 comprising jacking means for selectively disengaging each said mill wheel from its respective contact wheel or increasing the frictional engagement between the two in the event of wear.

* * * * *